US005537943A

United States Patent [19]

Bartholomä et al.

[11] Patent Number: 5,537,943

[45] Date of Patent: Jul. 23, 1996

[54] SEWING MACHINE PRESSER DEVICE, WITH CHAINING-OFF FOOT

[75] Inventors: Hans-Dieter Bartholomä, Filderstadt; Milan Petrovic, Hemmingen; Gernot Nedoschinsky, Leonberg; Johannes Strauss, Leinfelden, all of Germany

[73] Assignee: Union Special GmbH, Hemmingen, Germany

[21] Appl. No.: 373,413

[22] Filed: Jan. 17, 1995

[30] Foreign Application Priority Data

Feb. 14, 1994 [DE] Germany ..... 44 04 603.0

[51] Int. Cl.[6] ..... D05B 29/08

[52] U.S. Cl. ..... 112/235

[58] Field of Search ..... 112/235, 197, 112/237, 238, 239, 311

[56] References Cited

U.S. PATENT DOCUMENTS

| | | | |
|---|---|---|---|
| 3,382,830 | 5/1968 | LaPolice et al. | 112/235 |
| 3,495,560 | 2/1970 | Walling | 112/235 |
| 3,613,609 | 10/1971 | Hayes et al. | 112/235 |
| 3,623,441 | 11/1971 | Schoij et al. | 112/235 |
| 4,582,010 | 4/1986 | Niem et al. | 112/311 |
| 4,587,911 | 5/1986 | Kinoshita | 112/239 |
| 4,777,893 | 10/1988 | Bauer et al. | 112/235 |
| 5,138,962 | 8/1992 | Klundt | 112/235 X |

FOREIGN PATENT DOCUMENTS

| | | | |
|---|---|---|---|
| 261531A1 | 11/1988 | German Dem. Rep. . | |
| 3119716 | 11/1982 | Germany | 112/235 |

*Primary Examiner*—Ismael Izaguirre
*Attorney, Agent, or Firm*—Brinks Hofer Gilson & Lione

[57] ABSTRACT

A sewing machine comprises a workpiece presser device having a presser foot and a separate chaining-off foot. There is an independent holding down device for each foot which makes it possible to adjust both the presser foot pressure and also the chaining-off foot pressure by variable resilient forces.

14 Claims, 4 Drawing Sheets

SEWING MACHINE PRESSER DEVICE, WITH CHAINING-OFF FOOT

BACKGROUND OF THE INVENTION

The invention relates to a sewing machine of the type having a workpiece presser device above the work supporting surface, including a pivotable workpiece presser lever, one end of which is connected to a rod disposed parallel to the work supporting surface and transversely to the workpiece feed direction. The other end of the pivotable workpiece presser lever being connected to the presser foot which is biased downwardly in a resilient manner against the throat plate, A sewing machine of the type that this invention is an improvement upon is shown in U.S. Pat. No. 4,582,010. There is shown in this patent an embodiment including a rod, that is disposed transverse to the workpiece feed direction and parallel with the throat plate, one end of a workpiece presser lever is secured to the rod and the presser foot is carried by the other end of the workpiece presser lever. The presser foot is biased downwardly in a resilient manner, against the throat plate, by a hold down device. Although this prior art device renders it possible to adjust the downward pressure on the presser foot against the workpiece to be sewn, it does not allow separate adjustment of the pressure exerted on the thread chains at the rear of and in advance of the sewn workpiece.

SUMMARY OF THE INVENTION

The object of the invention is thus to provide a sewing machine having a workpiece presser device for which the downward pressure on the workpiece can be controlled as well as a separate adjusting mechanism for controlling the pressure on the chaining-off chain of thread.

This object is achieved by virtue of a chaining-off foot (38), which comprises a chaining shoe (44) that is drivably connected to the upper part (9) of the sewing machine in such a manner as to move up and down. The chaining-off foot is resiliently urged under the influence of a separately disposed holding down device (55) against the throat plate (3). By arranging the chaining-off foot in accordance with the invention such that it is drivably connected to the upper part of the sewing machine and resiliently urged down by an independent holding down device against the throat plate or chain of thread, it is now possible in a convenient manner by means of two adjustment screws to separately adjust the force acting upon the workpiece shoe and the force acting upon the chaining-off sole. In this way it is possible to separately optimize the pressure acting upon the workpiece and the pressure acting upon the chain of thread. In so doing, the reliability of the stitching when forming a chain of thread, i.e. when chaining-off without a workpiece, is increased.

Expedient and advantageous embodiments of the sewing machine having a workpiece presser device according to this invention are described in the claims.

The description herein of a preferred embodiment of the invention serves in conjunction with the drawing to provide a further explanation.

DETAILED DESCRIPTION OF THE PREFERRED EMBODIMENT

Figure 1:
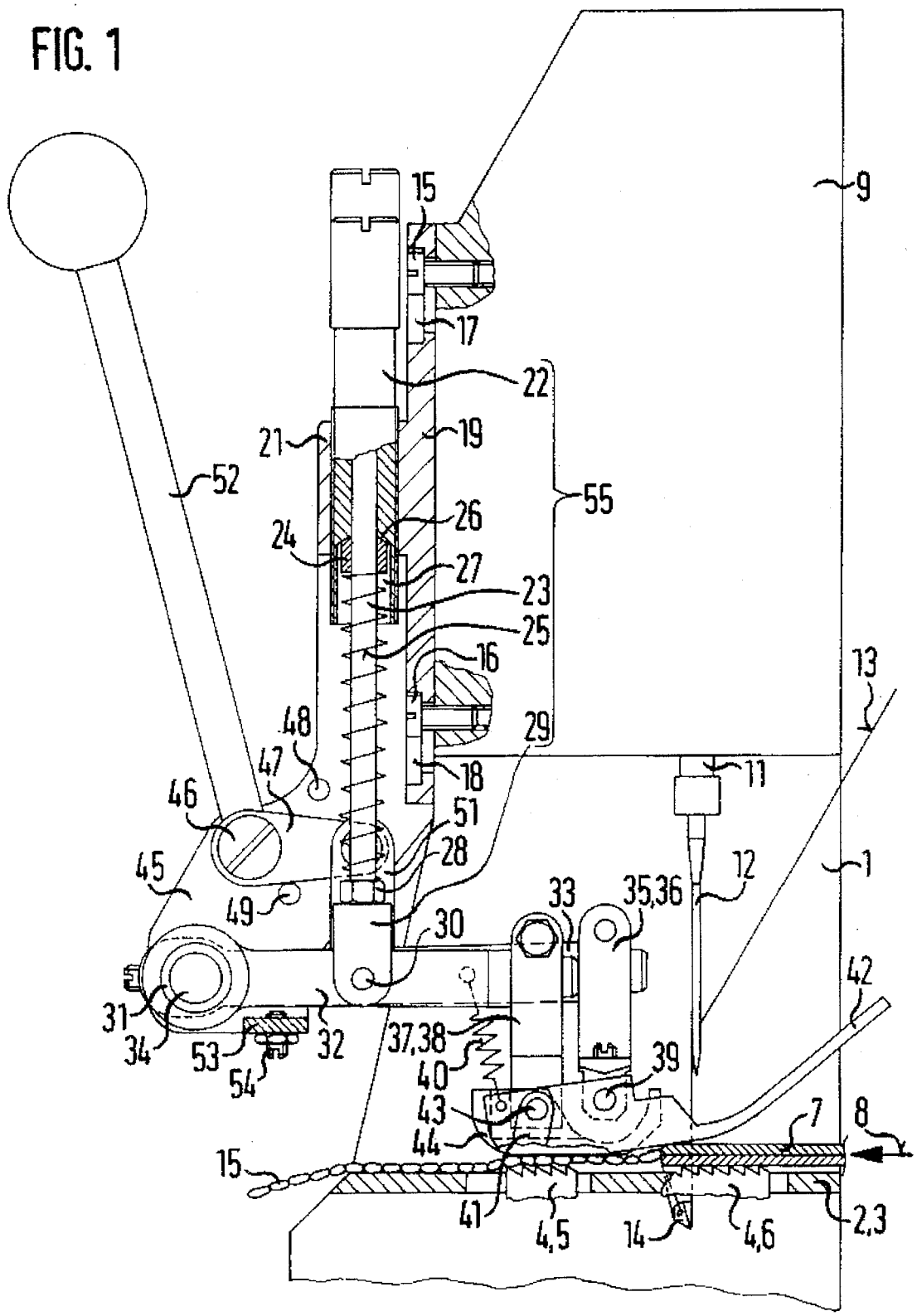
FIG. 1 shows a partially broken away lateral view of a sewing machine including a workpiece presser device and a workpiece located in advance of the chaining sole.

There is shown in FIG. 1, a sewing machine 1 having a workpiece presser device comprises a workpiece support 2 including a throat plate 3. The throat plate 3 is penetrated by a row of chaining-off teeth 5 and a row of workpiece material engaging teeth 6 that are part of the feed dog 4. A two layer workpiece part 7, which represents for example a sack which is to be closed or sewn, is grasped by the workpiece material engaging teeth 6 and, as illustrated by an arrow 8, is fed in the workpiece feed direction (arrow 8).

A needle bar 11, is mounted in an upper part 9 of the sewing machine, such that it can move up and down and supports a sewing machine needle 12 at its lower end. A thread chain 15, e.g. stitch type 101 or 401 according to ISO 4915, is formed from the needle thread 13 and a looper thread as a result of the conventional cooperation of the sewing machine needle 12, throat plate 3 and looper 14.

A support 19, which can be vertically adjusted by means of slots 17 and 18 that are formed therein, is attached at the upper part 9 of the sewing machine by screws 15 and 16. However, the support 19 could be constructed as an integral part of the upper part 9 of the sewing machine. An adjustment screw 22 is mounted in such a manner as to be able to be screwed into a threaded piece 21 of the support 19. The adjustment screw 22 functions to guide a rod 23 in such a manner as to be axially displaceable. The rod 23 has secured thereto a sleeve 24 that has a spherical shaped section, which is pushed by means of a spring 25 against a ball socket 26, which is disposed in an opening 27 of the adjustment screw 22. The rod 23 is attached by a nut 28 to a fork 29 which is pivotally mounted, by means of a pin 30, to the chaining-off presser lever 32. The chaining-off presser lever 32 has a bearing bushing or hub 31 at one end.

A pivotally mounted workpiece presser lever 33 is connected at one end to a rod 34 that is disposed parallel to the workpiece support 2 and transversely to the workpiece feed direction. The workpiece presser lever 33 is fixedly connected by means of a screw 71 to the rod 34. The other end of the workpiece presser lever 33 is connected to the presser foot 36 through the leg 35. A chaining-off foot 38 includes a chaining-off leg 37 that is drivably connected to the upper part 9 of the sewing machine such that it can move up and down. One end of the chaining-off presser lever 32 is pivotally mounted with respect to the workpiece presser lever 33 through the bearing bushing or hub 31, which surrounds the rod 34, whereas the other end is connected to the chaining-off foot 38. It is contemplated that the chaining-off foot 38 could also be vertically guided instead of mounted in a pivot bearing as illustrated. Such guides are known for presser feet and are therefore not further described.

The bottom end of leg 35 supports a pin 39, on which a presser foot shoe 42 is mounted for articulation. One end of a spring 40 is connected to the presser foot shoe 42 and there is an elongated slot 41 formed in the presser foot shoe 42.

The spring 40 which is attached at the one end at the presser foot shoe 42 is attached at the its other end in a bore 67 formed in the workpiece presser lever 33. The bottom end of chaining-off leg 37 supports a pin 43, which mounts for articulation a chaining-off shoe 44. The pin 43 protrudes into the elongated slot 41 that is formed in the presser foot shoe 42.

Figure 2:
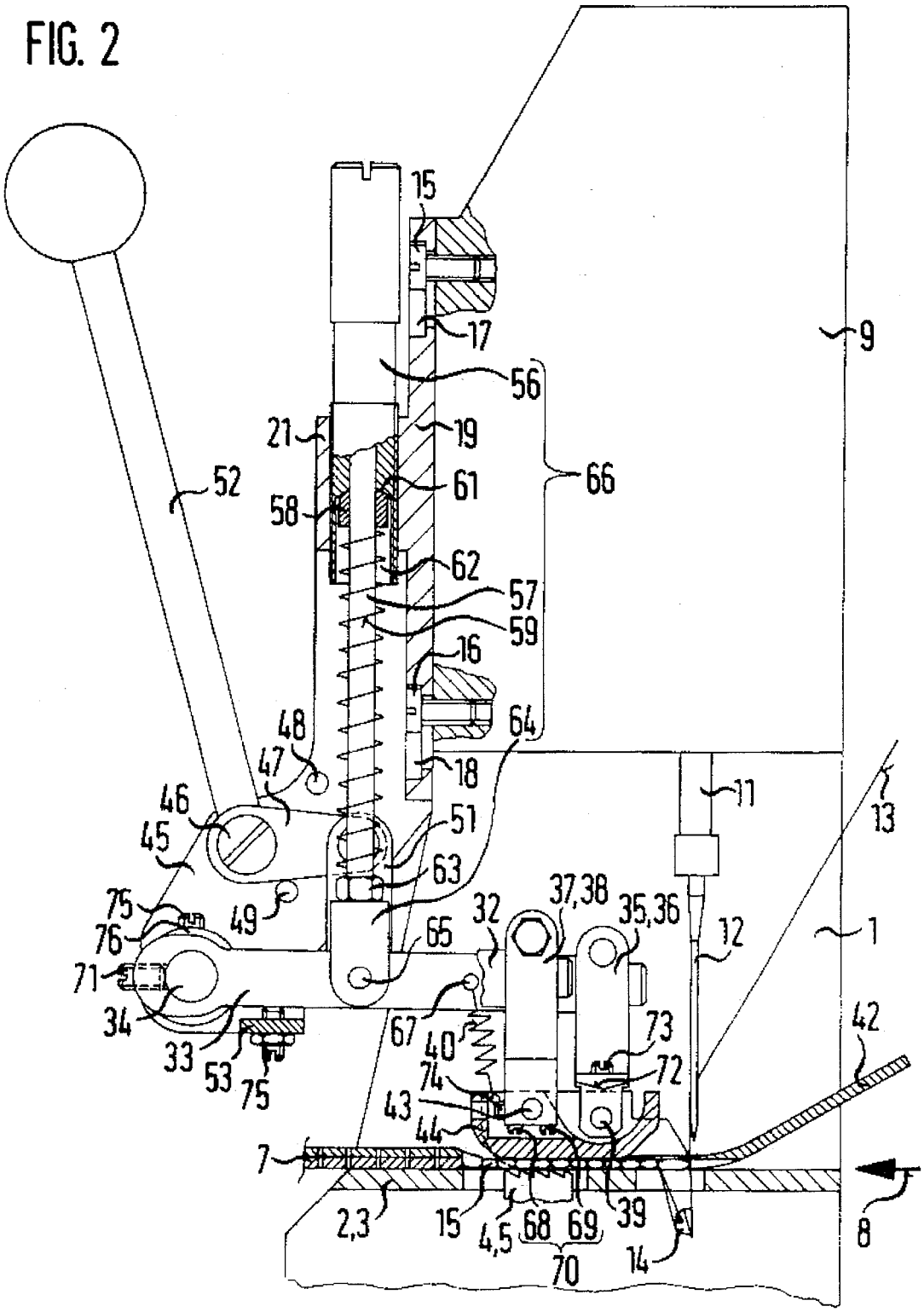
FIG. 2 shows a partially broken away lateral view of a sewing machine having a workpiece presser device and a workpiece located to the rear of the chaining sole.
Figure 3:
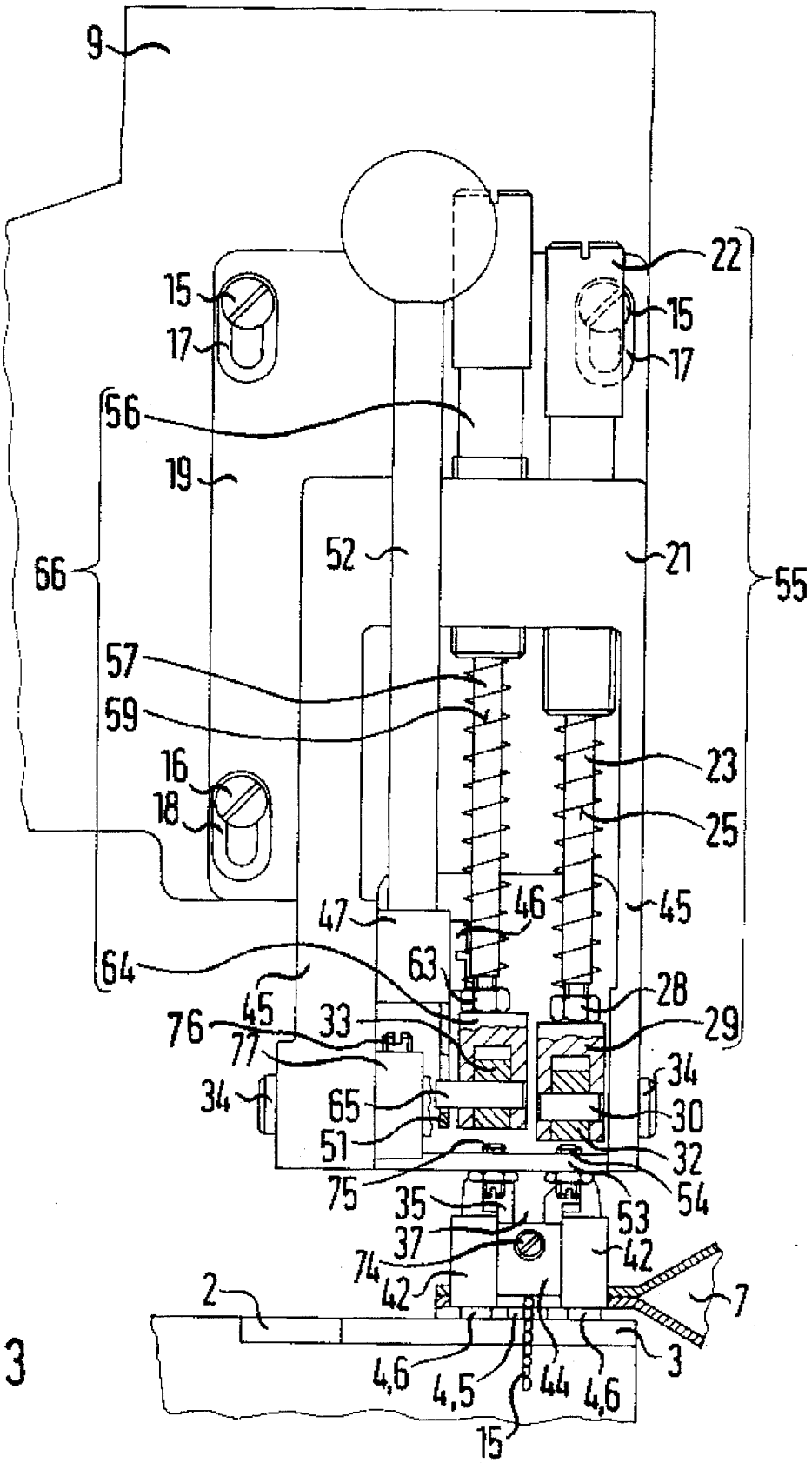
FIG. 3 shows a partially broken away rear view of a sewing machine having a workpiece presser device and a workpiece in advance of the chaining sole.
Figure 4:
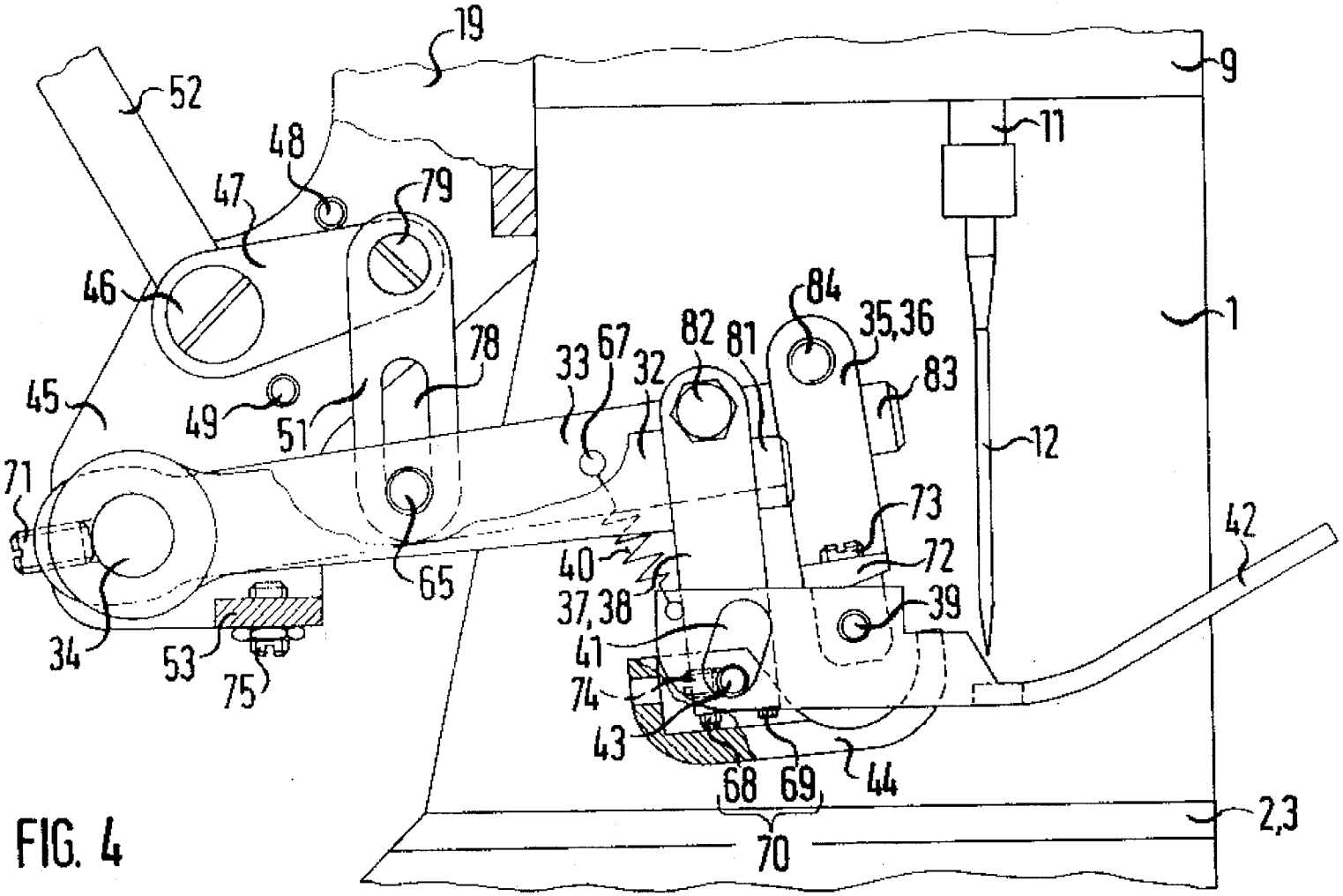
FIG. 4 shows an enlarged partial lateral view of the workpiece presser device in a raised condition.

The rod 34 is pivotally mounted at the bottom end of a U-shaped double limb member 45 that extends downwardly from the support 19. The bottom ends of the double limb member 45 are connected by a web 53. As best seen in FIG. 3, a lifting lever 47 is pivotally mounted on the double limb member 45 by means of a collar screw 46. As best seen in FIGS. 1, 2 and 4 the pivot range of lifting lever 47 is defined by an upper stop 48 and a lower stop 49. A link 51 is pivotally attached to the lifting lever 47, which as a result of the elongated hole 41 formed in the presser foot shoe 42, first allows the raising of the presser foot 36 and subsequently the raising of the chaining-off foot 38. A rod 52 that can be grasped by the sewing machine operator is attached to the lifting lever 47 which facilitates the raising of both the presser foot 36 and also the chaining-off foot 38.

An adjustable stop 54 disposed on the web 53 of the double limb member 45 defines the pivot range of the chaining-off presser lever 32 in the direction towards the throat plate 3. The fork 29, rod 23, spring 25 and the adjustment screw 22 are all part of the holding down device 55.

Referring to FIG. 1, the workpiece 7 is disposed in advance of the chaining-off shoe 44 and the chain of thread 15 is clamped between the chaining-off shoe 44 and the row of chaining-off teeth 5. The chain of thread 15 and the workpiece 7 are advanced in the workpiece feed direction (arrow 8). When the workpiece 7 engages the presser foot shoe 42, the shoe is raised and pivoted about the pin 39 in order to compensate for the thickness of the workpiece 7.

In FIG. 2, the workpiece 7 has advanced to a position behind the chaining-off shoe 44. The chain of thread 15 is clamped on the one hand between the row of chaining-off teeth 5 and the chaining-off shoe 44 and on the other hand between the throat plate 3 and the chaining-off shoe 44. The chaining-off foot 38 is raised in comparison to the presser foot 36 by an amount equivalent to the thickness of the chain of thread 15.

A second adjustment screw 56 is mounted by screwing it into the threaded piece 21 of the support 19. A rod 57 is guided in the adjustment screw 56 such that it can be axially displaced. The rod 57 has secured thereto a sleeve 58 having a spherical surface, which is urged by a spring 59 against a ball socket 61 and which is disposed in an opening 62 formed in the adjustment screw 56. The bottom end of rod 57 is attached by a nut 63 to a fork 64, which is pivotally mounted on the workpiece presser lever 33 by a pin 65. The fork 64, rod 57, spring 59 and the adjustment screw 56 are all part of a second holding down device 66 which is separate from the holding down device 55.

As best seen in FIGS. 2 and 4, the chaining-off leg 37 of the chaining-off foot 38 includes screws 68 and 69, which serve as an adjustable stop 70 for the chaining-off shoe 44 and establishes the pivot range of the chaining-off shoe 44 about pin 43.

As best seen in FIGS. 2 and 4 the leg 35 of the presser foot 36 includes a truncated wedge shaped stop 72, which establishes the pivot range of the presser foot shoe 42 about the pin 39. The assembly of the presser foot shoe 42 and the chaining-off shoe 44 are alleviated by the use of a screw 73 which serves to secure the pin 39 in the presser foot 36 and a screw 74 that serves to secure the pin 43 in the chaining off foot 38. The web 53 carries an additional adjustable stop 75, which defines the pivot range of the workpiece presser lever 33 towards the throat plate 3. As best seen in FIG. 3, the pivotally mounted rod 34 is secured against axial displacement towards the left relative to the double limb member 45 by means of an adjustment ring 77 which is secured by a screw 76. The rod 34 is secured against axial movement towards the right by the workpiece presser lever 33 that is attached by the screw 71 and by the pivotally mounted presser lever 32, which is in sliding contact against the right lateral wall of the double limb member 45.

FIG. 3 shows the rear side of the workpiece pressure devices that are seen in FIG. 1. FIG. 3 illustrates the arrangement of the separately disposed holding down device 55 and 66, which press on the chaining-off presser lever 32 and the workpiece presser lever 33. The adjustment screws 22 and 56 render it possible to independently, finely adjust the resilient forces of the springs 25 and 59, which act upon the chaining-off presser lever 32 and the workpiece presser lever 33.

FIG. 4 illustrates the workpiece presser device in a raised position with the lifting lever 47 in engagement with the upper stop 48. It is possible to raise the presser foot 36 and the chaining-off foot 38 during the stitching of the workpiece 7, when the lifting lever 47 is for example resting against the lower stop 49. This is a result of link 51, which is pivotally attached to the lifting lever 47 by a collar screw 79, and has an elongate slot 78 formed therein. The upper ends of legs 35 and 37 are bifurcated and include surfaces that form hubs. The chaining-off foot 38 is attached by a screw 82 that clamps the bifurcated-hub end of chaining-off legs 37 to a journal 81 which is formed at the free end of the chaining-off presser lever 32. A second journal 83, is formed at the free end of the workpiece presser lever 33 and the presser foot 36 is mounted to said journal 83 by a screw 84 that clamps the bifurcated-hub end of leg 35 to the journal 83. The above described attachments to the journals 81 and 83 permit compensation for any manufacturing tolerances and ensures that both the presser foot shoe 42 and the chaining-off shoe 44 lie in a planar manner on the throat plate 3.

The elongate slot 41 formed in the presser foot shoe 42 and the pin 43 that extends into slot 41 render it possible to first raise the presser foot shoe 42 in steps and subsequently to raise the chaining-off shoe 44. It is thus ensured that when using the lifting lever 52 both the presser foot 36 an the chaining-off foot 38 can be raised relative to the throat plate 3.

We claim:

1. In a sewing machine of the type having a workpiece presser device on the upper part of the sewing machine, a workpiece support on the lower part of the sewing machine, said workpiece presser device comprises a pivotable workpiece presser lever, which is connected at one end to a rod disposed parallel with the workpiece support and transversely to the workpiece feed direction and connected at its other end to a presser foot having a shoe, and a holding down device for urging the workpiece presser lever, in a resilient manner, against the sewing machine throat plate, wherein the improvement comprises:

a chaining-off foot, including a chaining shoe, that is operatively connected through a pivoted lever to the upper part of the sewing machine such that said chaining-off foot is movable up and down, an independently disposed holding down device acting on said chaining-off foot urging it, in a resilient manner, against said throat plate, and said presser foot shoe of said workpiece presser device partially encompasses said chaining-off foot.

2. A sewing machine according to claim 1, wherein the improvement further comprises:

said one end of the chaining-off presser lever is mounted concentric to said rod.

3. A sewing machine according to claim 2, wherein the improvement further comprises:

said presser foot includes a presser foot leg, said presser foot shoe pivotally mounted on said presser foot leg, said presser foot leg includes a stop for limiting the pivot range of said presser foot shoe relative to said presser foot leg.

4. A sewing machine according to claim 1, wherein the improvement further comprises:

said presser foot shoe being mounted on said upper part of the sewing machine such that said presser foot shoe pivots relative to said chaining-off foot and is lifted independently of said chaining-off foot, and further wherein said chaining-off foot is mounted on said upper part of the sewing machine and is lifted relative to said presser foot shoe.

5. A sewing machine according to claim 4, wherein the improvement further comprises:

said presser foot includes a presser foot leg, said presser foot shoe pivotally mounted on said presser foot leg, said presser foot leg includes a stop for limiting the pivot range of said presser foot shoe relative to said presser foot leg.

6. A sewing machine according to claim 1, wherein the improvement further comprises:

said presser foot includes a presser foot leg, said presser foot shoe pivotally mounted on said presser foot leg, said presser foot leg includes a stop for limiting the pivot range of said presser foot shoe relative to said presser foot leg.

7. In a sewing machine of the type having a workpiece presser device on the upper part of the sewing machine, a workpiece support on the lower part of the sewing machine, said workpiece presser device comprises a pivotable workpiece presser lever, which is connected at one end to a rod disposed parallel with the workpiece support and transversely to the workpiece feed direction and connected at its other end to a presser foot having a shoe, and a holding down device for urging the workpiece presser lever, in a resilient manner, against the sewing machine throat plate, wherein the improvement comprises:

a chaining-off foot, including a chaining shoe, that is operatively connected through a pivoted lever to the upper part of the sewing machine such that said chaining-off foot is movable up and down, an independently disposed holding down device acting on said chaining-off foot urging it, in a resilient manner, against said throat plate, a chaining-off presser lever having ends, one end of said chaining-off presser lever being pivotally mounted with respect to the workpiece presser lever and the other end being connected to said chaining-off foot, and said presser foot shoe of said workpiece presser device partially encompasses said chaining-off foot.

8. A sewing machine according to claim 7, wherein the improvement further comprises:

said stop on said chaining-off leg being adjustable.

9. A sewing machine according to claim 7, wherein the improvement further comprises:

said presser foot includes a presser foot leg, said presser foot shoe pivotally mounted on said presser foot leg, said presser foot leg includes a stop for limiting the pivot range of said presser foot shoe relative to said presser foot leg.

10. In a sewing machine of the type having a workpiece presser device on the upper part of the sewing machine, a workpiece support on the lower part of the sewing machine, said workpiece presser device comprises a pivotable workpiece presser lever, which is connected at one end to a rod disposed parallel with the workpiece support and transversely to the workpiece feed direction and connected at its other end to a presser foot having a shoe, and a holding down device for urging the workpiece presser lever, in a resilient manner, against the sewing machine throat plate, wherein the improvement comprises:

a chaining-off foot, including a chaining shoe, that is operatively connected through a pivoted lever to the upper part of the sewing machine such that said chaining-off foot is movable up and down, an independently disposed holding down device acting on said chaining-off foot urging it, in a resilient manner, against said throat plate, and said chaining-off foot includes a chaining-off leg and said chaining-off shoe is pivotally mounted on said chaining-off leg.

11. A sewing machine according to claim 10, wherein the improvement further comprises:

said chaining-off leg comprises a stop for limiting the pivot range of said chaining-off shoe relative to said chaining-off leg.

12. In a sewing machine of the type having a workpiece presser device on the upper part of the sewing machine, a workpiece support on the lower part of the sewing machine, said workpiece presser device comprises a pivotable workpiece presser lever, which is connected at one end to a rod disposed parallel with the workpiece support and transversely to the workpiece feed direction and connected at its other end to a presser foot having a shoe, and a holding down device for urging the workpiece presser lever, in a resilient manner, against the sewing machine throat plate, wherein the improvement comprises:

a chaining-off foot, including a chaining shoe, that is operatively connected through a pivoted lever to the upper part of the sewing machine such that said chaining-off foot is movable up and down, an independently disposed holding down device acting on said chaining-off foot urging it, in a resilient manner, against said throat plate, said one end of the chaining-off presser lever is mounted concentric to said rod, and a chaining-off presser lever having ends, one end of said chaining-off presser lever being pivotally mounted with respect to the workpiece presser lever and the other end being connected to said chaining-off foot.

13. A sewing machine according to claim 12, wherein the improvement further comprises:

said presser foot shoe being mounted on said upper part of the sewing machine such that said presser foot shoe pivots relative to said chaining-off foot and is lifted independently of said chaining-off foot, and further wherein said chaining-off foot is mounted on said upper part of the sewing machine and is lifted relative to said presser foot shoe.

14. A sewing machine according to claim 12, wherein the improvement further comprises:

said presser foot includes a presser foot leg, said presser foot shoe pivotally mounted on said presser foot leg, said presser foot leg includes a stop for limiting the pivot range of said presser foot shoe relative to said presser foot leg.

* * * * *